US010252567B2

(12) United States Patent
Nosek et al.

(10) Patent No.: US 10,252,567 B2
(45) Date of Patent: Apr. 9, 2019

(54) CHALK LINE APPARATUS

(71) Applicant: Keson Industries, Inc., Aurora, IL (US)

(72) Inventors: Jude Nosek, Oak Park, IL (US); Mark Nepil, St. Charles, IL (US); Bryan Shova, Chicago, IL (US); Audra Bielskus Norvilas, Chicago, IL (US); Jennifer Bae Park, Chicago, IL (US); Hilary Farnsworth, New Rochelle, NY (US); Phillip Prestia, Wantagh, NY (US); Leonard Mak, Woodside, NY (US)

(73) Assignee: Keson Industries, Inc., Aurora, IL (US)

( * ) Notice: Subject to any disclaimer, the term of this patent is extended or adjusted under 35 U.S.C. 154(b) by 119 days.

(21) Appl. No.: 15/255,470

(22) Filed: Sep. 2, 2016

(65) Prior Publication Data

US 2016/0368314 A1 Dec. 22, 2016

Related U.S. Application Data

(63) Continuation of application No. 15/075,867, filed on Mar. 21, 2016, now abandoned.

(60) Provisional application No. 62/135,477, filed on Mar. 19, 2015.

(51) Int. Cl.
*B44D 3/38* (2006.01)

(52) U.S. Cl.
CPC ..... *B44D 3/38* (2013.01)

(58) Field of Classification Search
CPC ..... B44D 3/38
USPC ..... 33/414
See application file for complete search history.

(56) References Cited

U.S. PATENT DOCUMENTS

| | | | | | |
|---|---|---|---|---|---|
| 3,311,319 | A * | 3/1967 | Campbell | B44D 3/38 | 242/394 |
| 4,765,557 | A * | 8/1988 | Kahmann | B44D 3/38 | 33/414 |
| 6,957,495 | B1 * | 10/2005 | Schmillen | B44D 3/38 | 33/413 |
| 9,701,154 | B2 * | 7/2017 | Parker | B44D 3/38 | |
| 2008/0236442 | A1 * | 10/2008 | Spaulding | B44D 3/38 | 33/414 |
| 2009/0025237 | A1 * | 1/2009 | Alexander | B44D 3/38 | 33/414 |
| 2010/0011599 | A1 * | 1/2010 | Johnson | B44D 3/38 | 33/414 |
| 2016/0052332 | A1 * | 2/2016 | DeLeo | B44D 3/38 | 33/414 |

(Continued)

*Primary Examiner* — Yaritza Guadalupe
(74) *Attorney, Agent, or Firm* — Wood, Phillips, Katz, Clark & Mortimer

(57) ABSTRACT

A chalk line apparatus with a housing having a body with a top, a bottom, a front, a rear, and laterally spaced sides. The body defines an internal space within which a spool is operatively mounted. A drive assembly is operable through an actuator to cause flexible line to be accumulated on the spool. The body has a front opening through which flexible line from the spool can be directed to externally of the housing. The body has a width between the laterally spaced sides and a length between the front and rear of the body. The body width tapers between the front and rear of the body over a majority of the length of the body.

17 Claims, 7 Drawing Sheets

(56) References Cited

U.S. PATENT DOCUMENTS

| | | | | |
|---|---|---|---|---|
| 2016/0096396 | A1* | 4/2016 | Khangar | B44D 3/38 33/414 |
| 2016/0167425 | A1* | 6/2016 | Chernyshou | B44D 3/38 33/414 |
| 2016/0347117 | A1* | 12/2016 | Parker | B44D 3/38 |
| 2016/0368314 | A1* | 12/2016 | Nosek | B44D 3/38 |
| 2017/0173997 | A1* | 6/2017 | Nosek | B44D 3/38 |

* cited by examiner 190
159
22
64
88
14
10
186
24
V1
a'
b'
P
190

Fig. 10
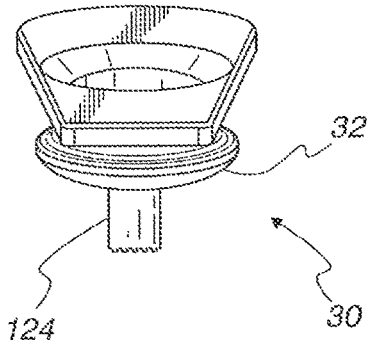
Fig. 11
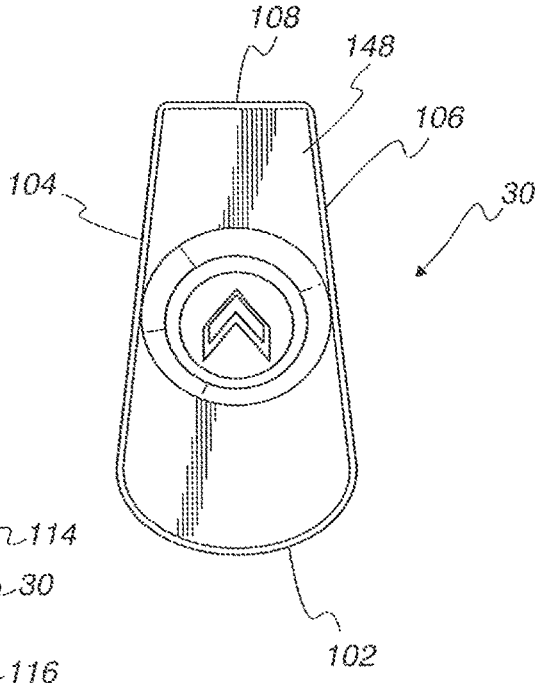
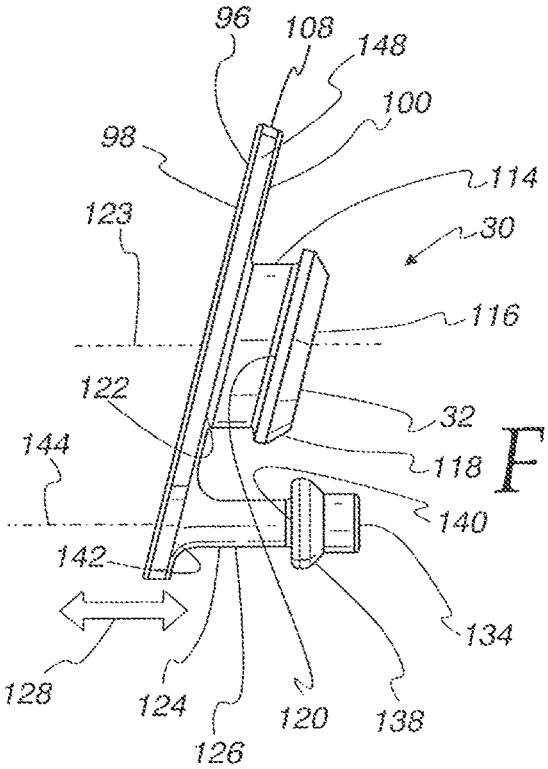
Fig. 12
Fig. 13
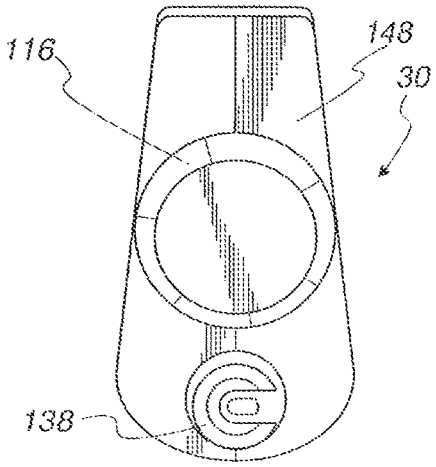
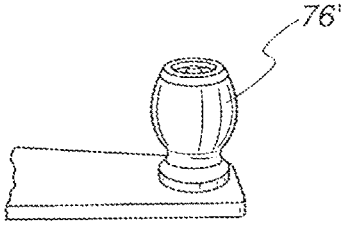
Fig. 14

CHALK LINE APPARATUS

BACKGROUND OF THE INVENTION

Field of the Invention

This invention relates to chalk line apparatus and, more particularly, to a chalk line apparatus having a housing in which a supply of flexible line is stored and from which the line can be paid out.

Background Art

A multitude of different chalk line apparatus is currently available, particularly for the construction trade. Common to most of these apparatus is a housing with an internal space within which a flexible line storage spool is located. A drive assembly, operable through an external handle, is used to turn the spool around its axis to progressively wrap line around the spool core to effect retrieval thereof. The line extends from the spool to externally of the housing for use. A supply of chalk within the internal space contacts the accumulated line on the spool and may also treat the line portion extending from the spool to an outlet opening at the front of the housing.

The housing has different sizes and shapes based upon the particular job requirements. For applications requiring use of large quantities of chalk, it is known to provide a housing with a large capacity internal space. These housings may incorporate a graspable handle for transportation and handling in use.

A more common configuration has a body around which a user's hand can be wrapped to facilitate both transportation and use of the apparatus. A known shape is shown in U.S. Pat. No. 6,098,299 entitled "Chalk Line Holder". The tapered forward housing region in this design facilitates handling of the housing body as paid out line is tensioned, preparatory to snapping a line. While the locally front tapered region facilitates handling, a user's palm region is still required to wrap around a relatively wide mid-portion of the housing. This may be awkward or uncomfortable for a user who does not have a relatively large hand.

It is common for users of the above type of chalk line apparatus to stow the apparatus when not in use in a tool holder, such as those suspended at a user's waist on his/her belt. The front taper facilitates initial entry of the housing body into these receptacles. However, this sliding entry into the tool receptacle may be inhibited by the wide mid-length dimension of the housing body as well as the projecting handle that is part of the actuator for the spool.

While narrower housing body configurations currently exist and to some degree address the above problems, those persons using existing designs still contend with these problems. A typical handle will generally have an elongate body with a graspable component at one end thereof. The opposite end is connected to the drive component on the drive assembly. While provision is often made for the handle to be placed in a stored state, wherein the graspable component on the handle nests in a receptacle in the housing, the entire handle still projects upwardly and may obstruct smooth transitioning of the apparatus into a storage space in a complementarily-shaped receptacle. This is particularly a problem since the handles oftentimes project upwardly a significant distance at a location spaced a short distance rearwardly from the front leading end of the housing body. The tapered front region of the housing body may slide only a short distance in before the handle encounters a part of the tool storage device or other object therewithin.

Further, the combined shape of the housing body and actuator handle may make grasping of the apparatus in a user's hand inconvenient and/or uncomfortable.

In spite of the large volume of chalk line apparatus that are utilized by both professionals and homeowners, chalk line apparatus generally are constructed so that users must contend with one or more of the above problems. The industry continues to seek out better alternative designs.

SUMMARY OF THE INVENTION

In one form, the invention is directed to a chalk line apparatus with a housing having a body with a top, a bottom, a front, a rear, and laterally spaced sides. The body defines an internal space within which a spool is operatively mounted. A drive assembly is operable through an actuator to cause flexible line to be accumulated on the spool. The body has a front opening through which flexible line from the spool can be directed to externally of the housing. The body has a width between the laterally spaced sides and a length between the front and rear of the body. The body width is tapered and increases from the front towards the rear of the body over a majority of the length of the body.

In one form, the body width tapers progressively from a first location that is closer to the rear of the body than the front of the body to a location adjacent the front of the body.

In one form, the body width increases from adjacent to the front of the body rearwardly and decreases progressively from the first location towards the rear of the body.

In one form, the laterally spaced sides have substantially straight portions at the front of the body that are at an angle of 30-40° with respect to each other.

In one form, the laterally spaced sides have substantially straight portions at the rear of the body that are at an angle of 45-55° with respect to each other.

In one form, the top of the body has an exposed surface that is inclined from front to rear over at least one third of the length of the body.

In one form, the actuator has an elongate handle that is turned around an axis to operate the drive assembly. The handle has a length and is changeable selectively between operative and stored states. The length of the handle is inclined from front to rear with the handle in the stored state.

In one form, the handle has a flat body with a surface that resides in a first plane. At least a portion of the exposed surface at the top of the body has a substantially flat shape that resides in a second plane. With the handle in the stored state, the first and second planes are substantially parallel.

In one form, the handle extends to adjacent the front of the body with the handle in the stored state.

In one form, the handle in the stored state extends from the front of the body rearwardly to a location equal to at least 40% of the length of the body.

In one form, the top of the body has an exposed substantially flat surface portion that resides in a plane and is inclined from front to rear of the body. The bottom of the body has a substantially flat surface residing in a plane. The planes of the flat surface portion at the top of the body and the flat surface at the bottom of the body are at an angle of 10-20° with respect to each other.

In one form, the actuator has a graspable component on the handle that can be repositioned by a user to move the handle so as to operate the drive assembly. The body has a receptacle adjacent the front of the body. The graspable component projects into the receptacle with the handle in the stored state.

In one form, the body has a beveled edge where the straight portions join to the top of the body.

In one form, the body has a beveled edge where the straight portions join to the bottom of the body.

In one form, the drive assembly has an input component that turns around an axis. The axis is closer to the rear than the front of the body.

In one form, the actuator has an elongate handle that is connected to the input component so that the handle can be repositioned to turn the input component around its axis. The handle is changeable between operative and stored states. The handle in the stored state extends to adjacent the front of the body.

In one form, the top of the body has an exposed surface that is inclined from rear to front of the body.

In one form, the body has a truncated "V" shape extending from the front of the body to a distance equal to at least 30% of the body length as viewed from a side elevation perspective.

In one form, the body has a truncated "V" shape extending from the front of the body to a distance equal to at least 30% of the body length as viewed from a top plan perspective.

In one form, the actuator has a handle with a flat surface that resides in a plane. The handle is changeable between operative and stored states. Exposed surface portions at the bottom and front of the body and a plane of the flat handle surface together have a truncated "V" shape as viewed from an elevated side perspective.

BRIEF DESCRIPTION OF THE DRAWINGS

FIGS. 10-13 show the stopper assembly on the apparatus in FIGS. 2-9 separated from the housing and from different perspectives; and FIG. 14 is a fragmentary, perspective view of a graspable component for the handle with an alternative shape to that for the graspable component on the handle shown in FIGS. 3 and 4.

DETAILED DESCRIPTION OF THE PREFERRED EMBODIMENT

Figure 1:
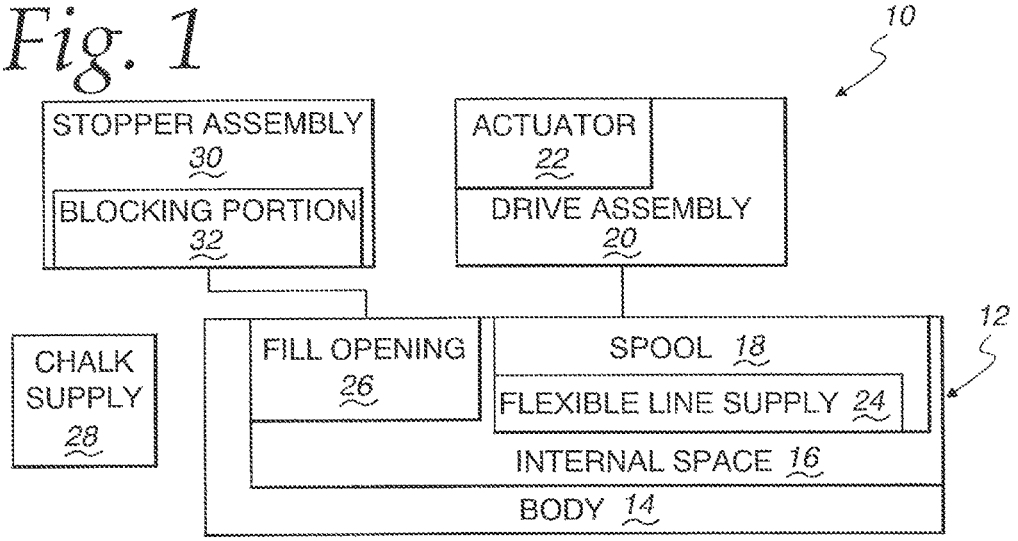
FIG. 1 is a schematic representation of a chalk line apparatus, according to the present invention.

In FIG. 1, a chalk line apparatus, according to the present invention, is shown in schematic form at 10. The apparatus 10 consists of a housing 12 with a body 14 defining an internal space 16 within which a spool 18 is operatively mounted. A drive assembly 20 is operable through an actuator 22 to cause a supply of flexible line 24 to be accumulated on the spool 18.

A fill opening 26 on the housing 12 permits a supply of chalk 28 to be introduced into the internal space 16 to contact the flexible line 24 on the spool 18 and/or projecting therefrom.

A stopper assembly 30 is configured to be selectively placed in closed and open states. The stopper assembly 30 has a blocking portion 32 that: a) blocks passage of chalk 28 through the fill opening 26 with the stopper assembly 30 in the closed state; and b) permits chalk 28 to be directed through the fill opening 26 and into the internal space 16 with the stopper assembly 30 in the open state.

The stopper assembly 30 is located adjacent to the drive assembly actuator 22.

The inventive concepts are capable of being incorporated into chalk line apparatus having a multitude of different configurations and components. The schematic representation of the chalk line apparatus 10 is intended to encompass those different versions and component variations, and additionally how those components interact. The schematic representation is intended to encompass the above structures and the preferred form of the invention, which is exemplary in nature only.

Referring to FIGS. 2-13, one specific form of the chalk line apparatus 10 will now be described. The body 14 on the housing 12 on the chalk line apparatus 10 has a top T, bottom B, a front F, a rear R, and laterally spaced sides S1, S2. The body has a length L between the front F and rear R and a width W between the sides S1, S2.

Figure 6:
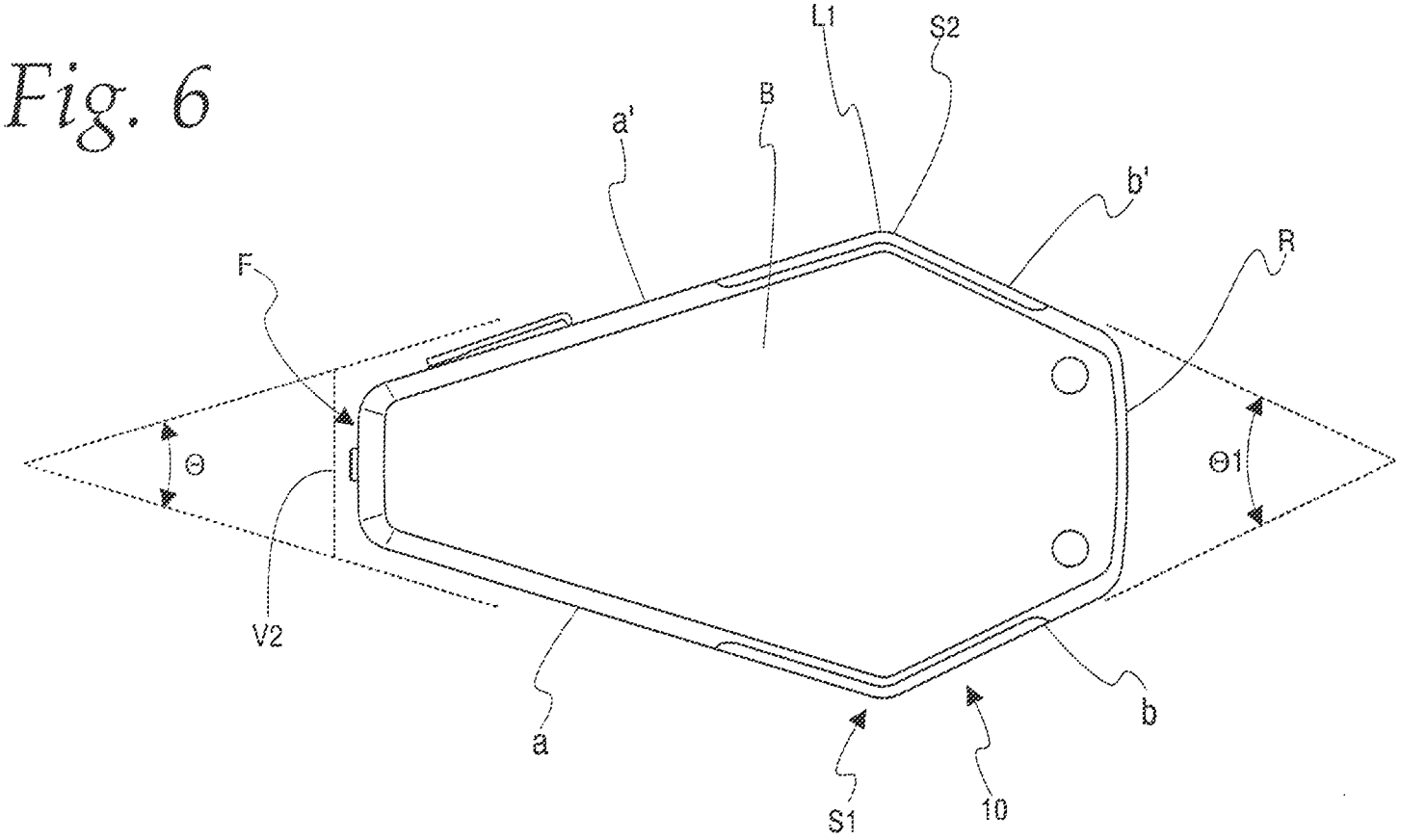
FIG. 6 is a bottom view of the chalk line apparatus in FIGS. 2-5.

As viewed from above, the housing body 14 has a deltoid shape that is truncated at the front F and rear R. As shown in FIG. 6, the side S1 is made up of angled front and rear, substantially straight portions a, b, with the side S2 made up of corresponding angled front and rear portions a', b'. The portions a, a' are at an angle θ with respect to each other, with the portions b, b' making an angle θ1. While the side portions a, b, a', b' depicted are substantially straight, they might be contoured while remaining effectively "straight" for purposes herein. It is intended that "straight" sides include sides with exposed surfaces that are contoured but reside effectively in a plane.

The progressive front width taper at the angle θ extends from a location L1, that is closer to the rear of the body than the front of the body 12, to a location adjacent the front of the body, whereby this taper extends over a majority of the length L of the body 14 in the depicted embodiment. The progressive taper rearwardly from the location L1 is not as functionally significant.

The angle θ is preferably in the range of 30-40°, with the angle θ1 preferably in the range of 45-55°. One preferred embodiment, as shown in the drawings, has θ, θ1 approximately in the centers of their respective identified preferred ranges. The drawings in FIGS. 2-13 are approximately to scale in terms of relationship of parts, including their relative dimensions. The overall size may change from what is depicted. Precise angles are not critical; however, the front region is preferably tapered, as viewed from multiple perspectives, for reasons explained in greater detail below.

The inclination of exposed surfaces will be described below relative to a horizontal reference plane P.

The spool 18 has a core 34 between spaced flanges 36, 38. The core 34 and flanges 36, 38 cooperatively define a storage volume at 40 for the flexible line 24 wrapped around the core 34.

The core 34 defines a vertical turning axis 42 for the spool 18 that is substantially orthogonal to the reference plane P. The core 34 has axially oppositely projecting stub extensions 44, 46 which are guided in receptacles 48, 50, respectively at the top and bottom of the housing body 14. The receptacle 48 is actually defined by a gear 52 that is part of the drive assembly at 20.

In this embodiment, the drive assembly 20 has an input component 54 that is turned around a vertically extending axis 56 to cause turning of the spool 18 around its axis 42. The axes 42, 56 are substantially parallel, though this is not required. The drive assembly 20 incorporates a gear 58 that meshes with the gear 52 to allow changing of the turning ratio of the input component 54 and spool 18 from 1:1. The relative sizes of the gears 52, 58 can be selected to arrive at a desired turning ratio.

While not critical to the present invention, the input component 54 is normally biased by a spring 60 into its operative position. By pushing downwardly on the input component 54 through an enlarged cap 62, the drive assembly 20 can be disengaged from the spool 18, whereby the spool 18 can be turned independently of the input component 54. This facilitates free payout of flexible line 24 from the spool 18 under an outward drawing force.

Figure 2:
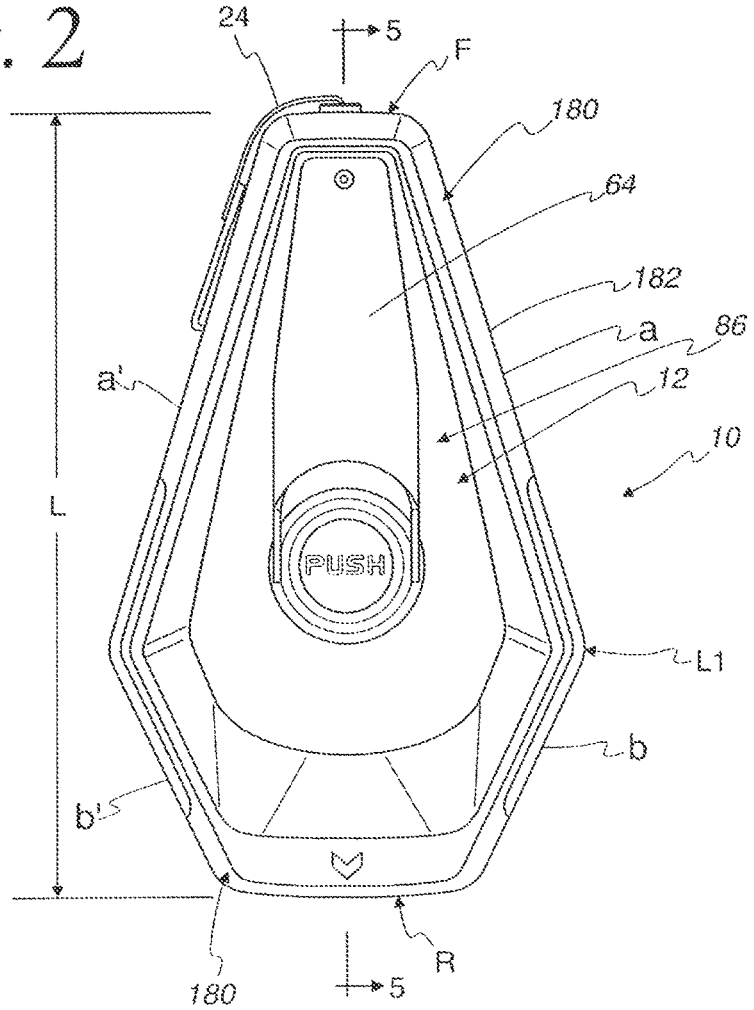
FIG. 2 is a plan view of one preferred form of chalk line apparatus, as shown schematically in FIG. 1, and with an actuator handle in a stored state.
Figure 3:
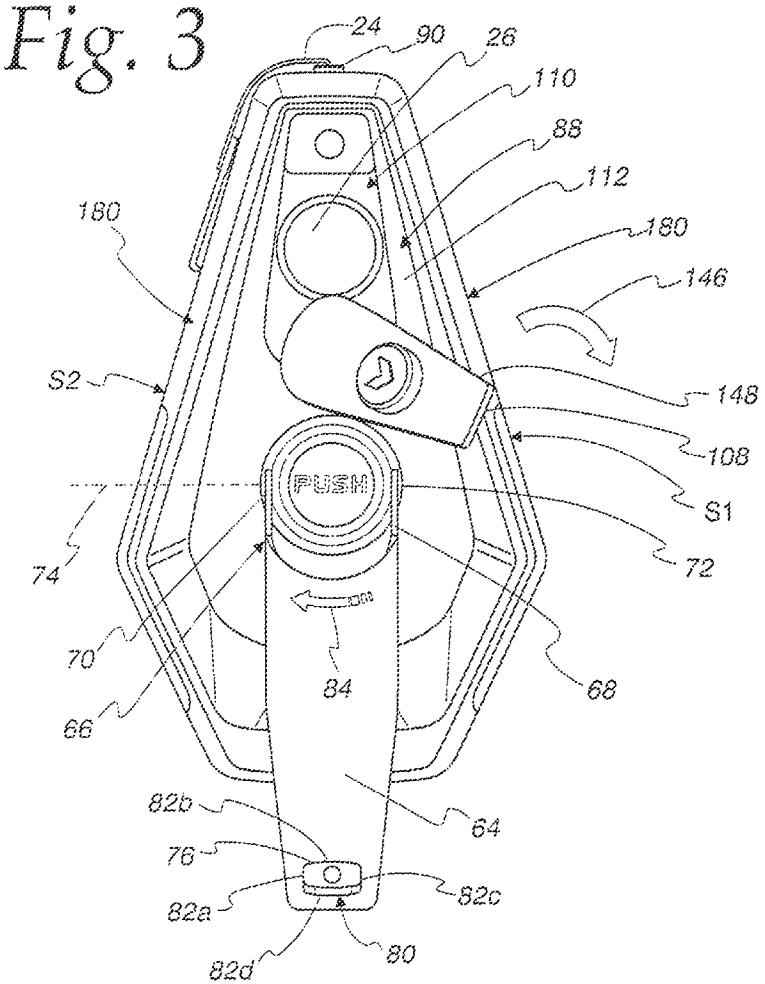
FIG. 3 is a view as in FIG. 2 with the handle in an operative state and a stopper assembly in an open state to allow replenishment of a supply of chalk within a housing on the apparatus.
Figure 5:
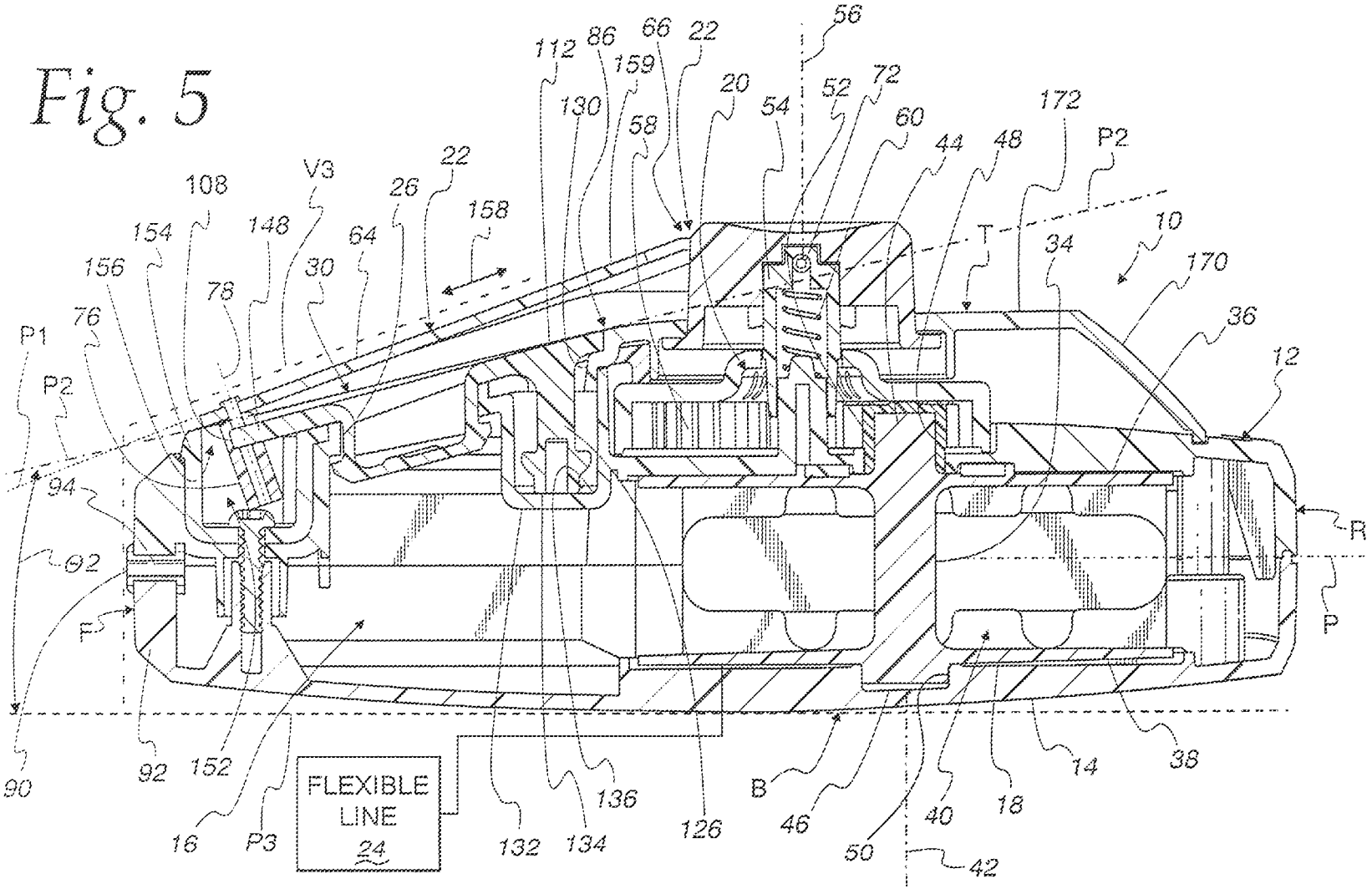
FIG. 5 is an enlarged, cross-sectional view of the chalk line apparatus taken along line 5-5 of FIG. 2.

The actuator 22 for the drive assembly 20 is in the form of an elongate handle 64 with a connecting end 66 attached to the input component 54. The connecting end 66 has a bifurcated shape with spaced arms 68, 70 that straddle the cap 62. A pivot pin 72 extends through the arms 68, 70 and the input component 54 to allow the handle 64 to pivot about a laterally extending axis 74 defined by the pivot pin 72 between a first position, as shown in FIG. 3, and a second position, as shown in FIGS. 2 and 5. The pivot pin 72 also connects the handle 64 and input component 54 so that they turn together around the axis 56. With the handle 64 in the first position of FIG. 3, the handle is in an operative state. With the handle 64 in the second position, as shown in FIGS. 2 and 5, the handle is in a stored state.

The actuator 22 is configured to be grasped remotely from the connecting end 66 and repositioned by turning around the axis 56. Turning is effected through a graspable component 76. The graspable component 76 is connected to a part of the elongate handle 64 for movement around an axis 78. The graspable component 76 has a peripheral outer surface 80 shown, in the depicted embodiment, to be made up of a plurality of substantially flat surface portions 82*a*. 82*b*, 82*c*, 82*d*, extending around the axis 78.

In an alternative form, as shown in FIG. 14, the graspable component 76' has a bulbous surface shape.

With the handle 64 in the first position of FIG. 3, the graspable component 76 can be engaged and manipulated to turn the handle in the direction of the arrow 84, which drives the input component 54 around the axis 56 to turn the spool 18 around its axis 42 to effect retrieval of the line 24.

With the handle 64 in the FIG. 3 position, the handle can be pivoted around the axis 74 to change the handle from its operative state into its stored state, as shown in FIGS. 2, 5, 7, and 9.

The actuator 22 is mounted on a wall 86 at the top of the housing body 14. The fill opening 26 is also provided on the top wall 86 adjacent to the actuator 22.

The top wall 86 has a portion at 88, inclined with respect to the reference plane P, within which the fill opening 26 is formed. The fill opening 26 provides an entry to the internal space 16 and, more particularly, a region of the internal space 16 that is forward of the spool 18 and through which the flexible line 24 passes.

A grommet 90 in a wall 92 at the front of the housing body 14 bounds an opening 94 through which the flexible line 24 projecting from the spool 18 extends to externally of the housing 12 for normal use.

The stopper assembly 30 has a substantially flat wall 96 with oppositely facing surfaces 98, 100. As viewed from above, the wall 96 has a rounded rear edge 102 that blends into converging side edges 104, 106 that terminate at a laterally extending straight edge 108 that connects between the edges 104, 106. The precise shape of the wall 96 is not critical and, as depicted, the shape nominally matches the corresponding shape of the top wall 86 at the front region of the housing body 14 where the stopper assembly 30 is located.

Figure 4:
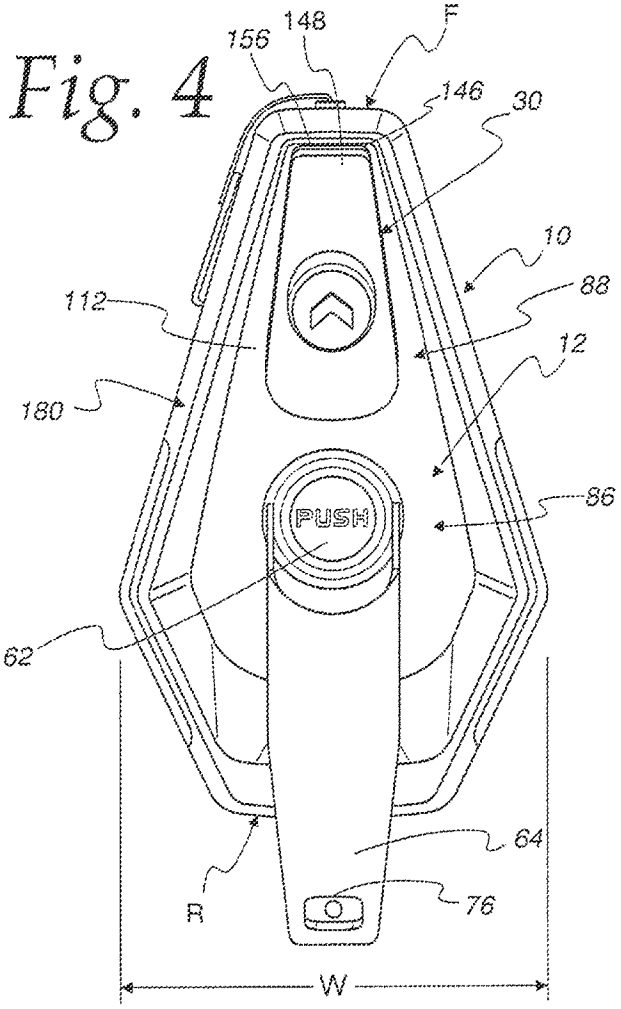
FIG. 4 is a view as in FIG. 3 with the stopper assembly changed to a closed state.

The inclined wall portion 88 has a recess at 110 at least nominally matched to the shape of the wall 96. With this arrangement, with the stopper assembly in its closed state, as shown in FIG. 4, the wall surface 98 is approximately flush with an exposed surface 112 at the top of the inclined wall portion 88. While a substantially flush arrangement is desirable, this is not necessary, nor is it necessary that the recess 110 accommodate the entire area of the wall 96.

The blocking portion 32 projects from the surface 100 on the wall 96. As depicted, the blocking portion 32 consists of a substantially cylindrical body 114 matching the shape of the fill opening 26. While cylindrical/round configurations are preferred, any matching shape that allows the blocking portion 32 to be pressed sealingly into the fill opening 26 is contemplated.

The blocking portion 32 has an enlarged bead 116 at its lower end. The bead has a tapered surface 118 that funnels the cylindrical body 114 into the fill opening 26.

The bead 116 defines an annular edge 120 that faces an annular edge 122 on the wall 96, between which edges a part of the top wall 86 is captively located with the stopper assembly in the closed state. The stopper assembly 30 and fill opening 26 are configured so that the bead 116 must be radially inwardly deformed with respect to the body axis 123 to be pressed through the fill opening 96. The cylindrical body 114 may likewise be radially compressed to effect a sealed connection.

The stopper assembly 30 further has an anchoring component 124 that projects away from the surface 100 of the wall 96 in the same direction of projection as the cylindrical body 114. The anchoring component 124 is in the form of an elongate post 126 with a length in the direction of the double-headed arrow 128. The post 126 is guided in a separate opening 130 through the top wall 86. The housing body 14 has a cup-shaped portion 132 that accommodates the inserted post 126. As seen in FIG. 5, a free end 134 of the post 126 abuts to a wall 136 on the body portion 132 with the stopper assembly 30 assembled to the housing 12.

The post 126 has an enlarged bead 138, configured generally as the bead 116, to funnel the post 126 into and through the wall opening 130. The bead 138 defines an annular edge 140 that faces an annular edge 142 at the base of the wall 96 where the post 126 departs from the surface 100. The wall 86 is captive between the edges 140, 142. The spacing between the edges 140, 142 is substantially greater than the thickness of the top wall 86, whereby the post 126 is slidable parallel to its length vertically relative to the housing to facilitate its repositioning while remaining attached to the housing body. At the same time, the post and housing body 14 cooperate to allow the post 126 to pivot about its lengthwise axis 144 relative to the housing body 14. The spacing between the edges 140, 142 determines the range of vertical translation permitted for the post 126.

As depicted, the entire stopper assembly 30 is made as a single piece. In one preferred form, this piece may be a molded rubber or other material that can be compressed to allow assembly to the housing 14 and separation therefrom. Preferably, at least a part of each of the stopper assembly wall 96, anchoring component 124, and blocking portion 32 is made from a single molded piece of deformable material.

The stopper assembly 30 is assembled to the housing body 14 by press fitting the post 126 through the opening in the top wall 86. The enlarged bead 138 avoids inadvertent withdrawal of the post 126 so that the stopper assembly remains tethered to the housing 14. With the post 126 in place, the stopper assembly 30 can be drawn upwardly and pivoted around the axis 144 to align the stopper assembly 30 with the fill opening 26. Through a simple press fit operation, the blocking portion 32 can be pressed sealingly into the fill opening 26.

When it is desired to add chalk 28 to the internal space 16, the stopper assembly 30 is pulled upwardly from the fill opening 26. The post length and shape permit the entire stopper assembly 30 to be raised and pivoted, as indicated by the arrow 146 in FIG. 3, to fully expose the fill opening 26.

To facilitate manipulation of the stopper assembly 30, a tab 148 is provided remotely from the post location. The tab 148 projects away from the post 126 to beyond the blocking portion 32 and terminates at the edge 108. With the stopper assembly 30 in the closed state of FIGS. 4 and 5, the free edge 108 aligns over a receptacle 152 defined by a cup-shaped portion 154 on the housing body 14. A slight gap is formed at 156 that allows passage of a user's fingertip that can be engaged with, and potentially under, the free edge 108, to facilitate lifting of the tab 148. Alternatively, a user can project an item into the receptacle 152 past the edge 108 to facilitate lifting of the tab 148. Once grasped, the tab 148 can be raised to pull the blocking portion 32 from the fill opening 26.

The tab 148 can be made with a relatively large cross-sectional area whereby a user can firmly grasp the same between his/her fingers and reposition the stopper assembly 30 as described above. For example, the tab 148 may have fore-and-aft and lateral dimensions each up to potentially one inch or more.

The receptacle 152, in addition to facilitating grasping of the tab 148, accommodates the graspable component 76 with the elongate handle 64 in its stored state to allow for a low profile construction.

As seen most clearly in FIG. 5, the length of the handle 64, as indicated by the double-headed arrow 158 in FIG. 5, is generally aligned with the slope of the exposed surface portion 112 on the inclined wall portion 88. More specifically, the handle 64 has a flat body with a surface 159 that resides in a plane P1 that is substantially parallel to a plane P2 within which the surface portion 112 on the top wall portion 88 resides. The inclined top wall surface portion 112 extends over at least one third of the body length. In the depicted form, the surface portion 112 extends rearwardly to at least the location L1.

The bottom B of the body while slightly crowned in both front-to-rear and side-to-side directions, resides substantially in a plane P3, that is parallel to the reference plane P.

The plane P3 makes an angle θ2 with the plane P2 of the surface portion 112 and an angle slightly greater than θ2 with the plane P1 of the handle surface 159. The angle θ2 is preferably in the range of 10-20° and, as depicted in the drawings, approximately at the center of that range.

The top of the body 14 has an exposed surface portion 170 that is inclined from rear to front in a relationship to the reference plane P. A discrete flat top surface portion 172 resides between the surface portions 112, 170 and is substantially parallel to the plane P.

With the handle 64 in its stored position, the handle 64, and the surface 159 thereon, extend to adjacent the front of the body 14 and rearwardly therefrom to a location equal to at least 40% of the length of the body 14. The rear portion of the stored handle 64 extends rearwardly to engage the input component 54, the axis of which is closer to the rear of the body 14 than the front of the body.

Accordingly, the front region of the chalk line apparatus 10 has a sleek funnel shape. The stored handle 64 is part of this shape and thus does not become an obstruction that interferes with handling or one that becomes prone to hanging up on foreign objects.

Figure 7:
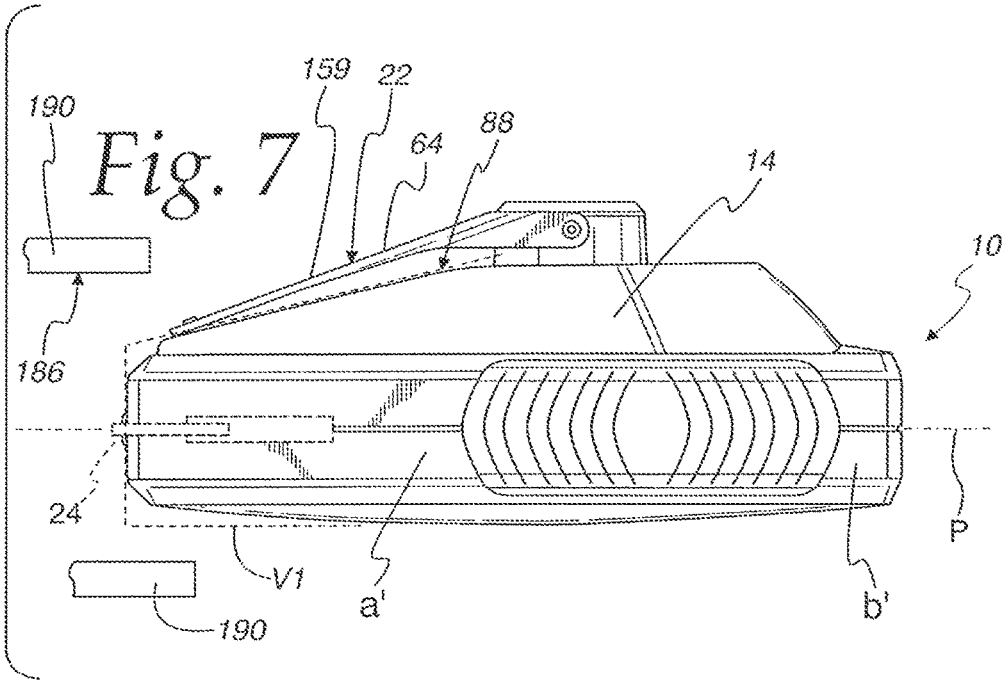
FIG. 7 is a side elevation view of the chalk line apparatus in FIGS. 2-6.
Figure 8:
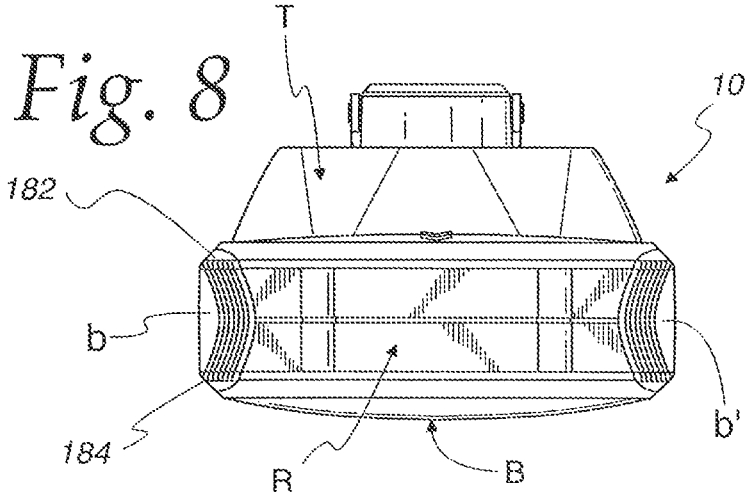
FIG. 8 is a rear elevation view of the chalk line apparatus in FIGS. 2-7.
Figure 9:
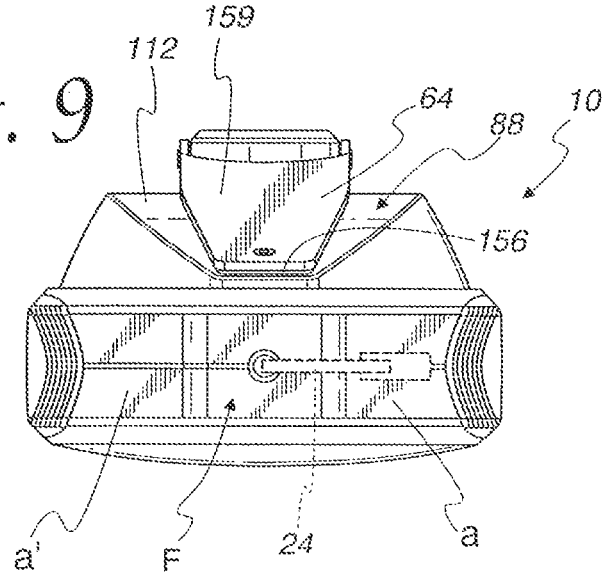
FIG. 9 is a front elevation view of the chalk line apparatus in FIGS. 2-8.

More specifically, the body 14 has a truncated "V" shape, as indicated generally by the dotted lines in FIG. 7 at V1, extending from the front of the body 14 a distance at least 30% of the body length as viewed from a side elevation perspective.

A corresponding truncated "V" shape, as indicated generally by the dotted lines V2 in FIG. 6, extends from the front of the body a distance at least 30% of the body length as viewed from the top plan perspective. As depicted, this distance is more than 40%, and potentially more than 50%, of the body length.

The plane P1 of the handle surface 159, the plane P3 at the bottom of the body 14, and front of the body 14 together define a truncated "V" shape, as indicated generally by the dotted lines V3 in FIG. 5, that is a side elevation perspective.

Some, and more preferably, most or all of the exposed, angled, transition edges/corners are beveled, as shown at 180, to make the apparatus more comfortable to grasp by eliminating sharp edges, particularly where body transitions occur between the top, bottom, sides, front, and rear. As just one example, a beveled surface 182 is formed where the straight portions a, b join to the top T of the body 14. A beveled surface 184 is formed when the straight portions a, b join to the bottom B of the body 14.

The funnel shape with potentially few sharp edges can be guided into a receptacle 186 on a storage device 190 (FIG. 7) conveniently and potentially without hangup. At the same time, this funnel shape can be conveniently and comfortably grasped and held in a user's hand when the apparatus is transported and in use.

The handle 64 overlies a substantial part of the stopper assembly 30 with the handle 64 in its stored state. Thus, the handle 64 provides a shielding arrangement which avoids damage to, or unintentional opening, and/or reconfiguration of, the stopper assembly 30.

The foregoing disclosure of specific embodiments is intended to be illustrative of the broad concepts comprehended by the invention.

The invention claimed is:

1. A chalk line apparatus comprising:

a housing having a body with a top with an upwardly facing surface, a bottom, a front, a rear, and laterally spaced sides with laterally oppositely facing surfaces, the body defining an internal space within which a spool is operatively mounted; and a drive assembly that is operable through an actuator to cause flexible line to be accumulated on the spool, the body having a front opening through which flexible line from the spool can be directed to externally of the housing, wherein the body has a width between the laterally spaced sides and a length between the front and rear of the body, wherein the body width is tapered and increases from the front towards the rear of the body over a majority of the length of the body, wherein the actuator comprises an elongate handle with a length, the elongate handle turned around an axis to operate the drive assembly, the elongate handle having operative and stored states, the elongate handle and housing configured to releasably maintain the elongate handle in a predetermined relationship with the housing with the elongate handle in the stored state wherein the length of the elongate handle projects from the axis toward the front of the housing, wherein the upwardly facing surface of the top of the body inclines continuously from front to rear over at least one third the length of the body, wherein each of the laterally oppositely facing side surfaces has a straight portion at the front of the body and the straight portions on the laterally oppositely facing side surfaces are at an angle of 30-40° with respect to each other, wherein at least a portion of the inclined upwardly facing surface is substantially flat and resides in one plane, wherein the handle has a body with a flat, upwardly facing surface that resides in another plane and with the handle in the stored state the one and another planes are substantially parallel.

2. The chalk line apparatus according to claim 1 wherein the body width tapers progressively from a first location that is closer to the rear of the body than the front of the body to a location adjacent the front of the body.

3. The chalk line apparatus according to claim 2 wherein the body width increases from adjacent to the front of the body rearwardly and decreases progressively from the first location towards the rear of the body.

4. The chalk line apparatus according to claim 1 wherein the laterally spaced sides comprise substantially straight portions at the rear of the body that are at an angle of 45-55° with respect to each other.

5. The chalk line apparatus according to claim 1 wherein the length of the handle is inclined from front to rear with the handle in the stored state.

6. The chalk line apparatus according to claim 1 wherein the handle extends to adjacent the front of the body with the handle in the stored state.

7. The chalk line apparatus according to claim 6 wherein the handle in the stored state extends from the front of the body rearwardly to a location equal to at least 40% of the length of the body.

8. The chalk line apparatus according to claim 6 wherein the actuator comprises a graspable component on the handle that can be repositioned by a user to move the handle so as to operate the drive assembly, the body defines a receptacle adjacent the front of the body and the graspable component projects into the receptacle with the handle in the stored state.

9. The chalk line apparatus according to claim 1 wherein the one plane is inclined from front to rear of the body, the bottom of the body has a substantially flat surface residing in a plane, and the one plane and the plane of the substantially flat surface at the bottom of the body are at an angle of 10-20° with respect to each other.

10. The chalk line apparatus according to claim 1 wherein the body has a beveled edge where the straight portions join to the top of the body.

11. The chalk line apparatus according to claim 1 wherein the body has a beveled edge where the straight portions join to the bottom of the body.

12. The chalk line apparatus according to claim 1 wherein the axis is closer to the rear than the front of the body.

13. The chalk line apparatus according to claim 12 wherein the handle in the stored state extends to adjacent the front of the body.

14. The chalk line apparatus according to claim 1 wherein the top of the body has an exposed upwardly facing surface portion that is inclined from rear to front of the body.

15. The chalk line apparatus according to claim 1 wherein the body has a truncated 'V' shape extending from the front of the body to a distance equal to at least 30% of the body length as viewed from a side elevation perspective.

16. The chalk line apparatus according to claim 1 wherein the body has a truncated "V" shape, defined by the substantially straight side portions, extending from the front of the body to a distance equal to at least 30% of the body length as viewed from a top plan perspective.

17. The chalk line apparatus according to claim 1 wherein the flat handle surface, a surface at the front of the body, and a bottom downwardly facing surface of the body cooperatively define a truncated "V" shape as viewed from an elevated side perspective.

* * * * *